US009903081B2

(12) United States Patent
Yoshiki et al.

(10) Patent No.: US 9,903,081 B2
(45) Date of Patent: Feb. 27, 2018

(54) FLOATING FLAP GATE

(71) Applicant: HITACHI ZOSEN CORPORATION, Osaka-shi, Osaka (JP)

(72) Inventors: Ryouta Yoshiki, Osaka (JP); Toru Itagaki, Osaka (JP); Shinichi Sayama, Osaka (JP)

(73) Assignee: HITACHI ZOSEN CORPORATION, Osaka-Shi, Osaka (JP)

( * ) Notice: Subject to any disclaimer, the term of this patent is extended or adjusted under 35 U.S.C. 154(b) by 46 days.

(21) Appl. No.: 15/219,945

(22) Filed: Jul. 26, 2016

(65) Prior Publication Data

US 2017/0044731 A1 Feb. 16, 2017

(30) Foreign Application Priority Data

Aug. 10, 2015 (JP) ..... 2015-158232

(51) Int. Cl.
*E02B 7/40* (2006.01)
*E02B 3/10* (2006.01)

(52) U.S. Cl.
CPC ..... *E02B 3/104* (2013.01); *E02B 7/40* (2013.01); *E02B 2201/00* (2013.01)

(58) Field of Classification Search
CPC . E02B 3/104; E02B 3/102; E02B 7/44; E02B 7/40; E02B 7/205; E02B 7/50; E06B 2009/007; E06B 3/38
See application file for complete search history.

(56) References Cited

U.S. PATENT DOCUMENTS 1,130,697 A * 3/1915 Meikle ..... H04Q 3/00 379/262
2,776,547 A * 1/1957 King ..... F25B 31/006 184/104.1
2014/0140770 A1* 5/2014 Nakayasu ..... E02B 7/44 405/107

(Continued)

FOREIGN PATENT DOCUMENTS

JP 2012-241449 A 12/2012
JP 2012251338 * 12/2012

*Primary Examiner* — Carib Oquendo
(74) *Attorney, Agent, or Firm* — Brinks Gilson & Lione

(57) ABSTRACT

To provide a floating flap gate that requires an auxiliary force of a counterweight or the like, and in which bending does not occur in a forward end portion of a door body, even in cases in which an installation site has a wide span. A floating flap gate 1 having a forward end portion 2*c* of a door body 2 that is configured to rotate around a base end portion serving as a fulcrum at a time of a rising water, so as to float upwards, and provided with an upper beam 2*d* attached to the forward end portion 2*c* of the door body 2 and a door body suspension member 3 contained within the upper beam 2*d*, and having two ends each being connected to one end of a wire rope 4. A counterweight 5 is connected to the other end side of the wire rope 4 as a pulling device. Bolts 6*b* are used as adjusting members interposed between the upper beam 2*d* and the door suspension member 3, and are inserted into bolt holes 6*a* provided on an upper surface of the upper beam 2*d*, so as to exert an opposing force to the tension of the wire rope 4 resulting from the weight of the counterweight 5 acting on the door body suspension member 3, the opposing force being applied uniformly to the upper beam 2*d* during ordinary use.

2 Claims, 5 Drawing Sheets

(56) References Cited

U.S. PATENT DOCUMENTS

2014/0328628 A1* 11/2014 Nakayasu ..... E02B 7/44
405/26
2014/0369754 A1* 12/2014 Waters, Jr. ..... E02B 3/104
405/16

* cited by examiner

PRIOR ART

PRIOR ART

FLOATING FLAP GATE

RELATED APPLICATIONS

This application claims priority under 35 U.S.C. § 119 to Japanese Patent Application No. 2015-158232 filed on Aug. 10, 2015, the entire content of which is hereby incorporated by reference.

TECHNICAL FIELD

The present invention relates to a floating flap gate that serves as a portion of a breakwater or is disposed at an opening in a breakwater, for example, in order to prevent a seawater from flowing onto land at a time of a tsunami or a high tide, by causing a door body to float. In particular, the present invention relates to a floating flap gate that requires an auxiliary force of a counterweight or the like, and that is suited for cases in which an installation site has a wide span.

BACKGROUND ART

A floating flap gate exists for which there is no delay in a floating action of a door body during an initial influx of water, so there is no overflow of water onto land during an initial influx of seawater at a time of a tsunami or a high tide, and which does not exhibit a hazardous behavior such as suddenly falling (e.g., Patent Reference 1).

A prior art floating flap gate 101 shown in FIGS. 5A, 5B and 5C has a single rod 103 attached, for example, across an entire width-wise direction of a forward end portion of a door body 102, functioning to support a load resulting from a water pressure and to attach one end of a wire rope 104.

The other end of the wire rope 104 is attached to a counterweight 120 via a fixed pulley 106 mounted on a door bumper 105 above a forward end portion 102*b* of the door body 102, and a fixed pulley 107 mounted above a base end portion 102*a* of the door body 102. Accordingly, during ordinary operation, the weight of the counterweight 120 is constantly acting on the forward end portion of the door body 102. In FIGS. 5A, 5B and 5C, rs is a channel surface at an opening, and 121 is a door bumper (holding portion).

At the initial stage of seawater influx, the counterweight 120 of the prior art floating flap gate 101 drops, so that the door body 120 is pulled in a rising direction, helping it to rise (see the operation illustrated in FIGS. 6A-6B).

In this type of floating flat gate, which employs a tension of a rope at both ends of a forward end portion of a door body, the greater the width of the door body, the greater the bending of the forward end portion of the door body resulting from the rope tension during ordinary use. There is a risk that a bending of the forward end portion of the door body could result in a rising upwards from the channel surface, which would inhibit safe travel of people and vehicles.

Increasing the thickness and rigidity of the door body was considered as a means to keep the amount of bending below an allowed value, but this inevitably increased the weight of the door body. An increase in the weight of the door body results in greater weight of the equipment as a whole, and thus increasing the cost.

PRIOR ART REFERENCES

Patent References

Patent Reference 1: Japanese Patent Application Kokai Publication No. 2012-241449

SUMMARY OF THE INVENTION

Problems to be Solved by the Invention

The problem that the present invention aims to solve is that when a floating flap gate requiring an auxiliary force of a counterweight is installed at a site having a wide span, increasing the door body thickness in order to reduce bending of the door body results in an increase in the weight of the door body, leading to an increase in weight of the equipment as a whole.

Means for Solving these Problems

The present invention was devised with the object of preventing a bending of a forward end portion of a door body (a rising upwards from a channel surface during ordinary use) resulting from a rope tension, without increasing a thickness of a door body, even in the case of a wide-span type floating flap gate requiring an auxiliary force of a counterweight, for example.

The present invention is a floating flap gate comprising:

a door body having a forward end portion and a base end portion, wherein the forward end portion is configured to rotate around the base end portion to float upwards in a direction of influx of a seawater during a tsunami or a high tide and within a plane in a height direction;

an upper beam attached to the forward end portion of the door body;

a door body suspension member contained within the upper beam and having two ends each being connected to one end of a rope;

a pulling device connected to the other end of the rope; and an adjusting member configured to apply an opposing force to a tension force of the rope due to the pulling device operating on the door body suspension member during ordinary use, the opposing force being applied uniformly to the upper beam.

According to the present invention, a door body suspension member is contained within an upper beam attached to the forward end portion of the door body, the two ends of the door body suspension member are connected to an end of a rope connected to a pulling device such as a counterweight, a compression coil spring, a tension coil spring, or the like.

According to the construction of the present invention, the weight of a counterweight operating on both ends of the door body suspension member is less than a force operating due to the dead weight of the door body, so the apparatus is in a static equilibrium during ordinary use when a buoyancy does not operate. At this time, the adjusting member applies an opposing force to the tension of the rope according to the pulling device operating on the door body suspension member (the opposing force being distributed uniformly), so that no bending occurs in a portion of the upper beam attached to the forward end portion of the door body.

Advantageous Effects of the Invention

According to the present invention, a construction is utilized wherein a door body suspension member is contained in the upper beam that forms the forward end portion of the door body, and an equally distributed force (equally distributed load) is transmitted from the door body suspension member bent by the weight of the counterweight to the upper beam via the adjusting member, thereby making it possible to make adjustments so that the upper beam rests horizontally on the bent suspension member. It is therefore possible to reduce bending of the forward end portion of the door body, even in the case of a floating flap gate installed in a site having a wide span, thus enabling the safe travel of people and vehicles.

BRIEF DESCRIPTION OF THE DRAWINGS

FIG. 3A is a partially cut-away sectional view along the position indicated by A-A in FIG. 2. FIG. 3B is an enlarged view of a portion of the bolt used as the adjusting member.

FIG. 4A is a partially cut-away sectional view along the position indicated by A-A in FIG. 2. FIG. 4B is an enlarged view of a portion where the retaining member is provided.

FIG. 5A is a side view. FIG. 5B is a front view. FIG. 5C is a planar view.

FIG. 6A illustrates an initial stage of influx. FIG. 6B illustrates an intermediate stage of raising the door body. FIG. 6C illustrates a later stage of raising the door body.

DETAILED DESCRIPTION OF THE PREFERRED EMBODIMENTS

The present invention achieves the object of preventing bending of the forward end portion of the door body, without increasing the thickness of the door, even if the floating flap gate is of a wide-span type that requires an auxiliary force such as a counterweight, by using an adjusting member that applies an opposing force to a tension of a rope resulting from a weight of the counterweight on a door body suspension member, the opposing force being applied uniformly (applied with a uniform distribution) to an upper beam.

EXAMPLE

Figure 1:
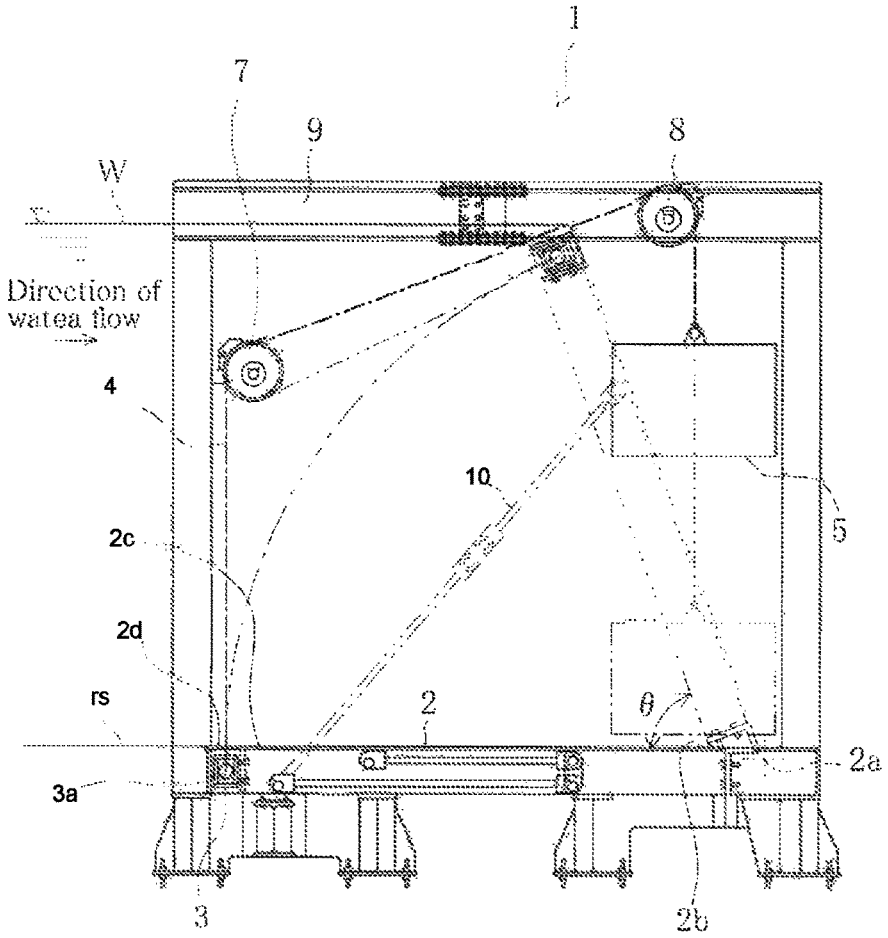
FIG. 1 is a schematic drawing of the entire floating flap gate according to the present invention, as viewed from the side.

An example of the present invention is described in detail below using FIG. 1 to FIGS. 4A and 4B. FIG. 1 is a schematic structural drawing of the floating flap gate according to the present invention.

In FIG. 1, Reference Numeral 1 is a floating flap gate according to the present invention which is disposed on a channel surface rs at an opening in a breakwater, for example. The floating flap gate 1 uses the pressure of a seawater W which approaches during a time of rising water due to a tsunami or a high tide to swing a forward end portion 2*c* of a door body 2 upwards around a rotating center 2*a* of a base end 2*b* as a fulcrum, within a plane in a height direction towards the seawater that is flowing in (the direction indicated by the arrow in FIG. 1), to block the opening of the breakwater in a water-tight manner, thereby preventing an influx of seawater into living spaces on the land. A lateral water-tight rubber (not pictured) is attached to both sides in the width-wise direction of the door body 2.

Figure 2:
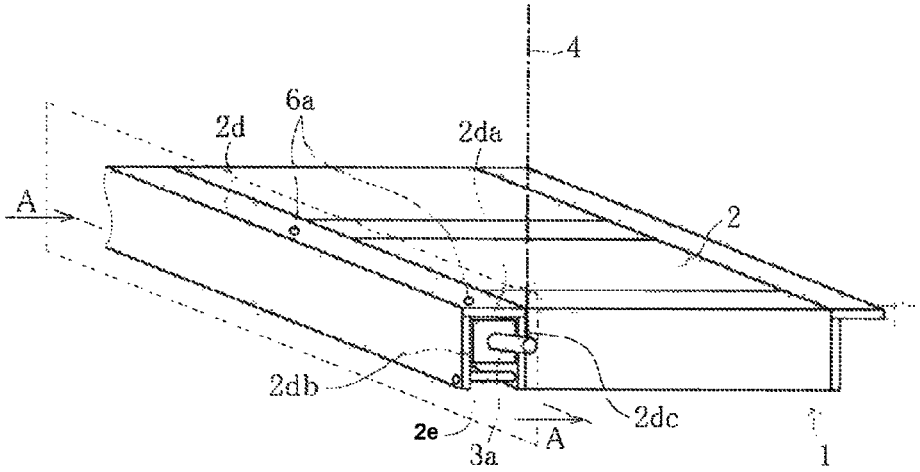
FIG. 2 is a drawing illustrating a state in which the upper beam and the door body suspension member are attached when the door body is lowered in a floating flap gate according to the present invention.
Figure 3A:
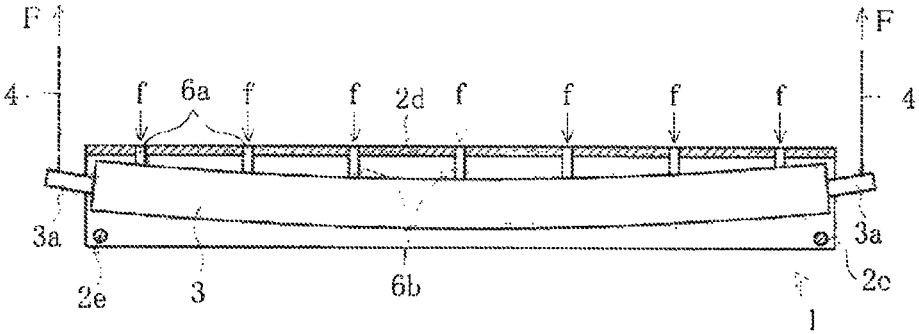
FIGS. 3A and 3B are drawings illustrating a state in which the upper beam and the door body suspension member are attached in the floating flap gate according to the present invention.
Figure 3B:
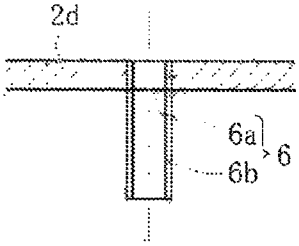

The floating flap gate 1 according to the present invention shown in FIG. 1 has an upper beam 2*d* attached to a portion of the forwardmost end of the forward end portion 2*c* of the door body 2. As shown in FIG. 2, the door body 2 is in a lowered state, and the upper beam 2*d* is a steel structure with the three surfaces positioned at the top and sides being steel sheets, and the lower end being open. Making reference to FIG. 2, the "surface positioned at the top" of the upper beam 2*d* refers to a single surface 2*da* which is one of the three surfaces forming the upper beam 2*d* and which is provided so as to be continuous with the upper surface of the door body 2. In addition, the "surfaces positioned on the sides" of the upper beam 2*d* are two surfaces 2*db* and 2*dc* which extend downward by as much as the thickness of the door body 2 from both side ends in the height direction of the door body 2.

In the present example, on the inner side of the upper beam 2*d*, there is contained a door body suspension member 3 formed from a steel plate provided with a rope connecting shaft 3*a* at both ends. There is a space between the inner surfaces of the steel sheets that form the door body suspension member 3 and the upper beam 2*d*. The rope connecting shaft 3*a* at both ends of the door body suspension member 3 passes through a guide groove provided in a side door bumper 9 on both sides, and protrudes into a holding portion. One end of a wire rope 4 is attached to each protruding rope connecting shaft 3*a*.

The other end of the wire rope 4 is connected to a counterweight 5 via a first fixed pulley 7 and a second fixed pulley 8 shown in FIG. 1, within a holding portion of the side door bumper 9 on each respective side, at the upper forward end and base send portion of the door body 2 when it is in a lowered state, for example. The present invention is not limited with regard to the position or height at which the first fixed pulley 7 and the second fixed pulley 8 are provided.

Accordingly, during ordinary use, the weight of the counterweight 5 is constantly acting on the door body suspension member 3 via the wire rope 4. In FIG. 1, Reference Numeral 10 is a tension rod for setting a limiting position for floating of the door body 2.

The first fixed pulley 7 is installed in such a manner that when the angle of inclination θ of the door body 2 during rising reaches 45° with respect to the surface of the water (in the same plane as the channel surface rs), the counterweight 5 is at its lowest point. The angle of inclination θ can be set at any desired angle without any problem, as long the angle is between 10° and 80°.

Accordingly, during a high tide or a tsunami, when a surging seawater tries to flow over the floating flap gate 1 onto land, the floating flap gate 1 according to the present invention utilizes a buoyancy created when the surging seawater acts on the door body 2 so that the door body 2 floats upwards passively and without human intervention. When this upward floatation starts, the counterweight 5 falls, which assists the door body 2 in floating upwards. In addition, when the angle of inclination θ of the door body 2 reaches 45° with respect to a horizontal plane, the counterweight 5 reaches its lowest position. When the angle of inclination θ of the door body 2 exceeds 45° with respect to a horizontal plane, the counterweight 5 rises because of the rising of the door body 2. As a result, the counterweight 5 causes resistance, which reduces the raising speed of the door body 2, and mitigates the force of impact when the door body 2 has finished rising.

In the present example, a retaining member 2*e* is provided at both ends on the side of the upper beam 2*d* in order to prevent the door body suspension member 3 from disengaging from the lower side of the upper beam 2*d* which is open, as a result of the tension of the wire rope 4 when the door body 2 has finished rising.

In cases where the water level falls in conjunction with a receding high tide or tsunami, at the initial stage of lowering of the door body, the counterweight 5 drops, the door body 2 is pulled in the direction of dropping and falls in conjunction with the falling water level. And when the angle of inclination θ of the door body 2 reaches 45° with respect to the surface of the water, the door body 2 and the wire rope 4 form a single line, and the counterweight 5 reaches a position at the lowest end. When the angle of inclination θ of the door body 2 is smaller than 45° with respect to the surface of the water, the counterweight 5 rises because of the lowering of the door body 2. As a result, the counterweight 5 causes resistance, which reduces the lowering speed of the door body 2, and mitigates the force of impact when the door body 2 has finished lowering.

Following is a description of the structure of an adjusting member 6*b* for adjusting the distance between the upper beam 2*d* and the door body suspension member 3, making reference to FIG. 2 to FIGS. 4A and 4B. As shown in FIG. 2, when the door body is lowered, an upper surface 2*da* of the upper beam 2*d* is provided with bolt holes 6*a* at a specified interval in the longitudinal direction of the upper beam 2*d*.

When the door body is lowering, the wire rope 4, which is connected to the counterweight 5, is connected to the rope connecting shaft 3*a* at both ends of the door body suspension member 3, and there is a force constantly acting to raise the door body suspension member 3 upwards. Because the force of the wire rope 4 due to the weight of the counterweight 5 is smaller than the force due to the dead weight of the door body 2, during ordinary operation when buoyancy does not operate, this state results in a static equilibrium.

In the present example, bolts 6*b* are used as adjusting members interposed between the upper beam 2*d* and the door suspension member 3 through the bolt holes 6*a*. An opposing force to the tension F of the wire rope 4 resulting from the weight of the counterweight 5 acting on both ends of the door body suspension member 3 is caused to be applied uniformly (applied with a uniform distribution) to the upper beam 2*d* via the bolts 6*b*, as shown by a plurality of arrows f in FIGS. 3A and 3B. The bolts 6*b* do not fasten the upper beam 2*d* and the door body suspension member 3, but rather, the bolts 6*b* serve as a means to adjust the distance between the upper beam 2*d* and the door body suspension member 3, by inserting the bolts 6*b* into the bolt holes 6*a*, so that the bolts 6*b* are interposed between the upper beam 2*d* and the door body suspension member 3.

In the present invention as described above, the door body suspension member 3 is in a bent state within the upper beam 2*d*. However, it is possible to maintain the upper beam 2*d* level with the channel surface rs, without bending, because the opposing force to the tension F of the wire rope 4 resulting from the weight of the counterweight 5 via the bolts 6*b* from the bent door body suspension member 3 is dispersed uniformly in the direction of the span. Accordingly, the floating flap gate 1 according to the present invention is able to prevent bending of the door body 2 during ordinary operation, thereby forming a level channel surface, and contributing to the safe travel of people and vehicles.

It should be noted that the weight of the counterweight 5 is smaller than the force exerted by the dead weight of the door body 2, and the door body suspension member 3 is bent by the weight of the door body 2, but the door body suspension member 3 is rigidly constructed so as not to bend any further.

Figure 4A:
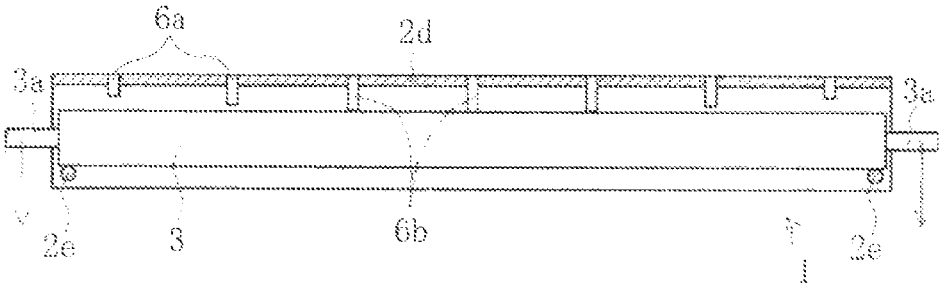
FIGS. 4A and 4B are drawings illustrating a state of the door suspension member when the door body is rising, and illustrates the function of the retaining member in the floating flap gate according to the present invention.
Figure 4B:
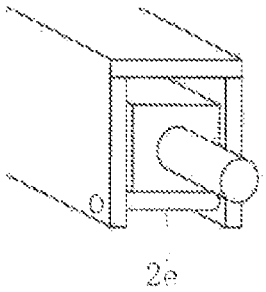
Figure 5A:
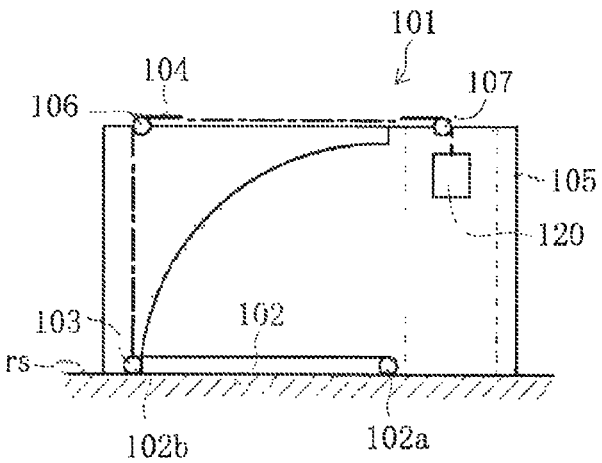
FIGS. 5A, 5B and 5C are schematic structural drawings of a prior art floating flap gate.
Figure 5B:
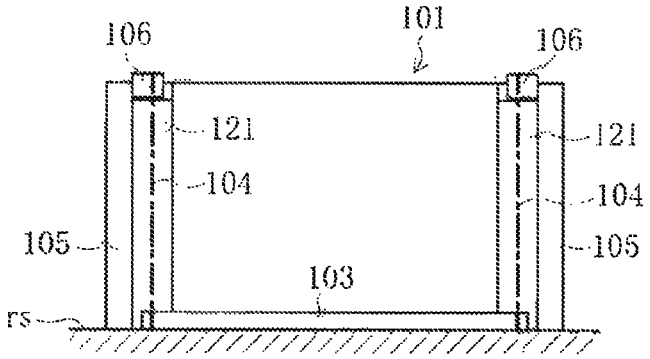
Figure 5C:
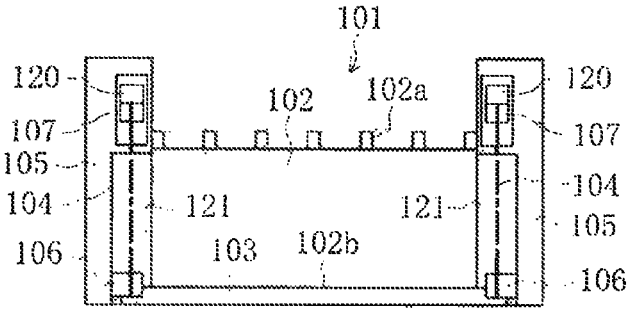
Figure 6A:
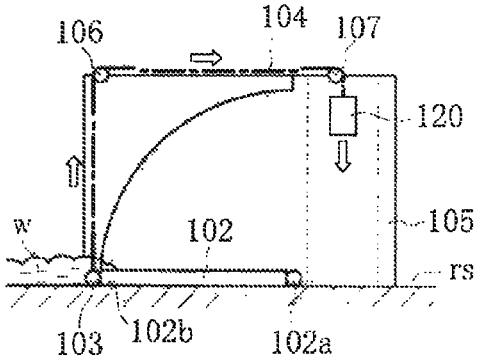
FIGS. 6A, 6B and 6C are drawings illustrating the operating principle of a prior art floating flap gate that uses a counterweight as an auxiliary force.
Figure 6B:
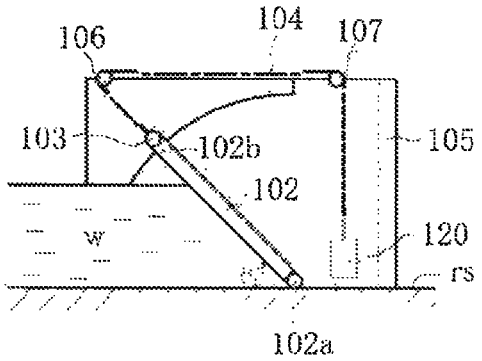
Figure 6C:
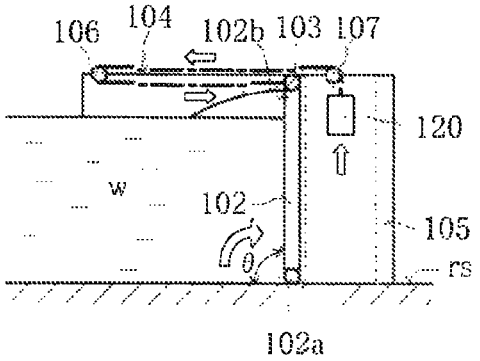

The above description described the action of the bolts 6*b* used as members for adjusting the bending of the door body suspension member 3 when the door body has been lowered. However, bending of the door body suspension member 3 is at its maximum when the door body is lowered, and at a time of rising water due to a high tide or a tsunami, the bending of the door body suspension member 3 gradually decreases due to the dead weight of the door body 2 as the door body 2 rotates and floats upwards. Also, as shown in FIGS. 4A and 4B, when the door body 2 has finished rising, almost no bending of the door body suspension member 3 is observed.

It should be additionally noted that when rising of the door body is completed, bending of the door body suspension member 3 is not completely 0, and there is a slight bending operating on the rope connecting shaft 3*a*, with the bolts 6*b* located in the center of the door body and the retaining member 2*e* as a fulcrum. However, as shown in FIG. 4A, because the distance between 2*e* and 3*a* is short, when rising of the door body is completed, the bending is on such a low level that it is not a problem from a practical standpoint. Therefore, when the door body 2 has finished rising, the function of the adjusting member is no longer needed. It should be noted that when rising of the door body is completed, the retaining member 2*e* prevents disengagement of the door body suspension member 3, and the retaining member 2*e* accommodates the weight of the counterweight 5.

According to the construction of the example described above which employed an adjusting means 6 formed from the bolt holes 6*a* provided in the upper beam 2*d* and the bolts 6*b* screwed into the bolt holes 6*a*, it is advantageous to freely adjust the distance between the upper beam 2*d* and the door body suspension member 3 simply by changing the amount that the bolts 6*b* are screwed in.

That is to say, employing an arch-shaped camber that is pre-fabricated to have a reverse bend is a conceivable mechanism for preventing bending of the forward end portion of the door body. However, in the case of the present invention, the door body suspension member 3 may be constructed so as to naturally bend backwards, and it is also possible to adjust for an optimal distance between the upper beam 2*d* and the door body suspension member 3 by using the bolts 6*b* that are provided as adjusting members. Therefore, in comparison to a mechanism employing a camber, the configuration of the present invention that employs an upper beam and a door body suspension member is advantageous in that fabrication is accomplished with little labor, and it is advantageous from the standpoint of cost as well.

The present invention is not limited to the above-described example, and the preferred embodiment may, of course, be advantageously modified within the scope of the technical ideas recited in the claims.

For example, the installation mode of the first fixed pulley 7 and the second fixed pulley 8 in the holding portion of the side door bumper 9 is not limited to the example shown in FIG. 1. As needed, moving pulleys may be used.

In the example described above, a tension rod 10 was installed for setting a limiting position for floating of the door body 2, but the tension rod 10 is a member that is not necessarily required.

A wire rope 4 is used in the example described above, but a rope may be used which is made from a fiber, such as a polyamide fiber, a polyester fiber, a polyethylene fiber, a polypropylene fiber, an aramid fiber, a polyarylate fiber, an ultra-high-density polyethylene fiber, or the like.

Moreover, in the example described above, the counterweight 5 was given as an example of a device for pulling the wire rope 4, but the pulling device is not limited thereto. For example, a spring mechanism such as a compression coil spring, a tension coil spring, or the like may be used as the pulling device.

In addition, in the example described above, the upper beam 2*d* has only the lower end open when the door body was lowered, but the upper beam 2*d* is not limited to this. For example, it may be a rigid body having an L-shaped lateral profile.

Further, in the example, it was advantageous for the bolt holes 6*a* to be provided at equal intervals in the longitudinal direction of the upper beam 2*d*, but the intervals do not necessarily have to be equal. Yet further, the number of bolt holes 6*a* is not limited to the number in the example shown in FIGS. 3A and 3B.

What is claimed is:

1. A floating flap gate comprising:

a door body having a forward end portion and a base end portion, wherein the forward end portion is configured to rotate around the base end portion to float upwards in a direction of influx of a seawater during a tsunami or a high tide and within a plane in a height direction;

an upper beam attached to the forward end portion of the door body;

a door body suspension member contained within the upper beam and having two ends each being connected to one end of a rope;

a pulling device connected to the other end of the rope; and an adjusting member configured to apply an opposing force to a tension force of the rope due to the pulling device operating on the door body suspension member during ordinary use, the opposing force being applied uniformly to the upper beam.

2. The floating flap gate according to claim 1, wherein the adjusting member comprises bolts interposed between the upper beam and the door body suspension member and inserted into bolt holes provided at a specified interval in a longitudinal direction of the upper beam.

* * * * *